US006280306B1

(12) United States Patent
Hosoki et al.

(10) Patent No.: US 6,280,306 B1
(45) Date of Patent: Aug. 28, 2001

(54) WAFER POLISHING APPARATUS AND WAFER MANUFACTURING METHOD

(75) Inventors: Kanji Hosoki; Hiroshi Shibaya; Masahito Komasaki; Jiro Sano; Kazuo Iizuka, all of Omiya (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/497,854

(22) Filed: Feb. 4, 2000

(30) Foreign Application Priority Data

Feb. 5, 1999 (JP) ..... 11-029389
Jun. 4, 1999 (JP) ..... 11-158802

(51) Int. Cl.[7] ..... B24B 29/00
(52) U.S. Cl. ..... 451/288; 451/398
(58) Field of Search ..... 451/41, 285, 286, 451/287, 288, 289, 388, 398

(56) References Cited

U.S. PATENT DOCUMENTS 5,205,082 * 4/1993 Shendon et al. ..... 51/283 R
5,584,751 * 12/1996 Kobayashi et al. ..... 451/288
5,803,799 * 9/1999 Volodarsky et al. ..... 451/288

* cited by examiner

*Primary Examiner*—Timothy V. Eley
*Assistant Examiner*—Dung Van Nguyen
(74) *Attorney, Agent, or Firm*—Oblon, Spivak, McClelland, Maier & Neustadt, P.C.

(57) ABSTRACT

The invention provides a wafer polishing apparatus and a wafer manufacturing method which can improve uniformity in polishing wafer surfaces. A wafer holding head comprises a head body; a diaphragm stretched inside the head body; a carrier fixed to the diaphragm to be displaceable in the direction of a head axis while holding the wafer; a retainer ring disposed around the carrier in concentric relation and fixed to the diaphragm to be displaceable in the direction of the head axis; and a thin plate disposed so as to project from the head body along a surface of the diaphragm. With the provision of the thin plate, an excessive pressing force acting upon the retainer ring from the diaphragm is suppressed, and the wafer surface can be prevented from being excessively polished at an outer peripheral edge.

8 Claims, 13 Drawing Sheets

WAFER POLISHING APPARATUS AND WAFER MANUFACTURING METHOD

BACKGROUND OF THE INVENTION

1. Field of the Invention

The present invention relates to a wafer polishing apparatus and a wafer manufacturing method which are employed in a semiconductor production process for polishing surfaces of semiconductor wafers.

2. Description of the Related Art

Recently, with finer patterns resulting from an increased packing density of semiconductor devices, it has become more important to polish surfaces of semiconductor wafers as flat as possible during a production process so that, in particular, fine patterns of a multilayered structure can be easily and reliably formed. Under such situations, an attention has been focused on the chemical mechanical polishing (CMP) process which can provide a higher degree of flatness in polishing surface films.

The CMP process means a process for polishing and planarizing wafer surfaces in a chemical and mechanical manner with, e.g., a alkaline solution using $SiO_2$ as an abrasive, a neutral solution using $SeO_2$, or an acidic solution using $Al_2O_3$. One example of wafer polishing apparatuses for implementing the CMP process is shown, by way of example, in FIG. 11.

Referring to FIG. 11, a wafer polishing apparatus 100 comprises a wafer holding head 101 for holding a wafer W to be polished, and a polishing pad 102 bonded to an overall upper surface of a platen 103 in the form of a disk. The wafer holding head 101 is provided in plural number and is mounted to the underside of a carousel 104 which serves as a head driving mechanism. Each wafer holding head 101 is rotatably supported by a spindle 111 and is rotated on the polishing pad 102 in planetary fashion. Incidentally, the center position of the platen 103 and the center about which the wafer holding heads 101 revolve may be offset from each other.

The platen 103 is horizontally arranged at the center of a base 105 and is rotatable about its axis by a platen driving mechanism provided within the base 105. Posts 107 are provided aside the base 105, and an upper mount plate 109 for supporting a carousel driving mechanism 110 is disposed between the posts 107. The carousel driving mechanism 110 has a function of rotating the carousel 104, provided below the mechanism 110, about its axis.

Abutment members 112 are disposed on the base 105 to project upward from the base 105, and spacing adjusting mechanisms 113 are provided on respective upper ends of the abutment members 112. Above the abutment members 112, engagement members 114 are disposed in one-to-one relation. The engagement members 114 are fixed to the upper mount plate 109 and are projected downward from it. The abutment members 112 and the engagement members 114 are brought into contact with each other while the spacing adjusting mechanisms 113 are operated to adjust a distance between the wafer holding heads 101 and the polishing pad 102 to a proper one. The wafers W held on the wafer holding heads 101 are thereby brought into contact with the surface of the polishing pad 102. The carousel 104 and the platen 103 are then rotated to polish the wafers W.

As shown in FIG. 12, the wafer holding heads 101 each comprise a head body 121 made up of a top plate 121a and a tubular peripheral wall 121*b* fixed to an outer periphery of the top plate 121*a*; a diaphragm 122 made of an elastic material such as rubber and stretched inside the head body 121; a disk-shaped carrier 123 fixed to a lower surface of the diaphragm 122; an annular retainer ring 124 disposed between an outer periphery of the carrier 123 and the peripheral wall 121*b* in concentric relation with small gaps left relative to them; and a pressure regulating mechanism 125 for regulating a pressure in a fluid chamber 126 defined between the head body 121 and the diaphragm 122.

The diaphragm 122 is held between the peripheral wall 121*b* and a diaphragm fixing ring 127, and it is fixed to the head body 121 by screws 127*a* tightened into the peripheral wall 121*b* from above the diaphragm fixing ring 127.

The carrier 123 is disposed on the lower side of the diaphragm 122, and a carrier fixing ring 128 is disposed on the upper side of the diaphragm 122 with the diaphragm 122 held between the carrier 123 and the carrier fixing ring 128. The carrier 123 is fixed to the diaphragm 122 by screws 128*a* tightened into the carrier 123 from above the carrier fixing ring 128.

The retainer ring 124 in the annular form is fitted to a circular groove defined between the peripheral wall 121b and the outer periphery of the carrier 123 such that the retainer ring 124 is positioned in concentric relation to the peripheral wall 121*b* and the carrier 123 while small gaps are left relative to both an inner surface of the peripheral wall 121*b* and an outer peripheral surface of the carrier 123. Further, a retainer-ring fixing ring 129 is disposed on the upper side of the diaphragm 122 with the diaphragm 122 held between the retainer ring 124 and the retainer-ring fixing ring 129. The retainer ring 124 is fixed to the diaphragm 122 by screws 129*a* tightened into the retainer ring 124 from above the retainer-ring fixing ring 129. The retainer ring 124 is of a two-piece structure comprising a metal-made upper portion into which the screws 129*a* are tightened, and a resin-made lower portion which is brought into contact with the polishing pad 102.

The wafer W is polished by the polishing apparatus including the above-described wafer holding head as follows. First, the wafer W is stuck to a wafer attraction sheet S, which is disposed on the underside of the carrier 123, so as to locate in imbedded fashion within the retainer ring 124. Then, the surface of the wafer W exposed to face downward is brought into contact with the polishing pad 102 bonded to the upper surface of the platen 103, and is polished under rotation of the wafer holding head while a slurry containing a polishing abrasive is supplied.

In the above operation, the carrier 123 and the retainer ring 124 are supported by a floating structure such that they can independently displace in the vertical direction with elastic deformation of the diaphragm 122. Therefore, pressing forces of the carrier 123 and the retainer ring 124 against the polishing pad 102 vary depending on the pressure in the fluid chamber 126 which is regulated by the pressure regulating mechanism 125.

A lower end of the retainer ring 124 projects downward of the carrier 123 and holds an outer periphery of the wafer W stuck to the lower surface of the carrier 123. This arrangement is intended not only to prevent the wafer W from dislodging from the carrier 123 during the polishing process, but also to prevent such a phenomenon that an outer peripheral area of the wafer W is polished in a larger amount than a central area thereof, by surrounding the wafer W with the retainer ring 124 and positioning a lower end surface of the retainer ring 124 at the same level as the lower surface (polished surface) of the wafer W.

In the above-described wafer polishing apparatus 100 in which the wafers W are polished by the polishing pad 102 with rotations of the wafer holding heads 101 and the platen 103, uniform polishing of the wafers W is achieved by satisfying such a condition that a relative speed, at which the polished surface of the wafer W and the polishing pad 102 rotate while contacting with each other, is uniform in a plane (hereinafter referred to as an "in-plane speed uniform condition). Assuming that the angular speed of the wafer holding head 101 is Rh, the angular speed of the platen 103 is Rp, and the angular speed of the carousel 104 is Rc, the in-plane speed uniform condition is expressed by the following relation and is satisfied when the following relation holds:

$$Rp=Rh+Rc \quad (1)$$

By polishing the wafer W under the above condition, the wafer W is uniformly polished when an apparatus has an ideal construction. Also, under the above condition, both the wafer W and the wafer holding head 101 are not subjected to rotating forces. Accordingly, no torsion in the rotating direction occurs in the diaphragm which is one component of the head.

Depending on polishing environment such as accuracy of parts constituting the apparatus and in assembly of the parts or a material of the polishing pad 102, however, the polishing pad 102 is locally raised (hereinafter referred to as "waving deformation") in a portion T inward of the position at which the polishing pad 102 contacts the retainer ring 124, as shown in FIG. 13, and the wafer W is often not uniformly polished even under the in-plane speed uniform condition. The raised portion T of the polishing pad 102 polishes excessively an outer peripheral edge G of the wafer W, and raises a problem of impairing uniformity in polishing of the wafer W surface.

Conversely, depending on polishing environment, a central area of the wafer W is sometimes preferentially polished. In such a case, it is also attempted to polish the wafer W under a condition where the in-plane speed is not uniform. The condition where the in-plane speed is not uniform means such a speed condition that the above relation (1) does not hold. In general, if the in-plane speed is not uniform, an outer peripheral area of the wafer W tends to be preferentially polished. Making the in-plane speed not uniform is therefore effective when a polishing state of the wafer W under the in-plane speed uniform condition provides a lower polishing rate in the outer peripheral area of the wafer W than that in the central area thereof, i.e., when the central area of the wafer W tends to be preferentially polished.

As a result of polishing of the wafer W under the in-plane speed non-uniform condition based on the above consideration, however, a conventional head has not developed such a tendency that the outer peripheral area of the wafer W is preferentially polished. This is attributable to the fact that the diaphragm is twisted due to rotating forces generated at the non-uniform in-plane speed, and the polishing becomes unstable. Also, in a transition stage where the rotations of the respective components does not yet reach steady states in an initial period of the polishing, the in-plane speed non-uniform condition occurs necessarily and the polishing becomes unstable during the transition stage.

SUMMARY OF THE INVENTION

In view of the state of art set forth above, an object of the present invention is to provide a wafer polishing apparatus and a wafer manufacturing method which can improve uniformity in polishing wafer surfaces.

To achieve the above object, the present invention provides a wafer polishing apparatus comprising a platen including a polishing pad bonded to a surface thereof, and a wafer holding head for holding a wafer to be polished and bringing one surface of the wafer into contact with the polishing pad, thereby polishing the wafer by rotating the wafer holding head and the platen separately, the wafer holding head comprising a head body made up of a top plate and a tubular peripheral wall provided under an outer periphery of the top plate; a diaphragm stretched inside the head body perpendicularly to a head axis; a pressure regulating mechanism for regulating a pressure of a fluid filled in a fluid chamber defined between the diaphragm and the head body; a carrier fixed to the diaphragm to be displaceable in the direction of the head axis together with the diaphragm, and holding the other surface of the wafer to be polished; a retainer ring disposed between an inner surface of the peripheral wall and an outer peripheral surface of the carrier in concentric relation, and fixed to the diaphragm to be displaceable in the direction of the head axis together with the diaphragm, the retainer ring being brought into contact with the polishing pad during polishing; an annular thin plate disposed in contact with at least part of the diaphragm; and a first fixing device (a diaphragm fixing ring and screws) for fixing the thin plate to the head body while the thin plate is projected from the head body along a surface of the diaphragm.

With the present invention, since the thin plate is disposed in contact with part of the diaphragm, deformation of the diaphragm in the axial (vertical) direction can be restricted. Therefore, a pressing force acting upon the retainer ring from the diaphragm can be reduced. A reduction of the pressing force acting upon the retainer ring enables a pressing force acting upon the polishing pad from the retainer ring to be reduced. As a result, when the polishing pad is made of a soft material and is apt to cause waving deformation, for example, the waving deformation can be prevented by providing the thin plate on the head body, and the wafer surface can be prevented from being excessively polished at an outer peripheral edge.

Preferably, the thin plate is fixing by a second fixing device (a carrier fixing ring and screws) and a third fixing device (a retainer-ring fixing ring and screws) respectively to the carrier and the retainer ring with the diaphragm held therebetween. With this feature, torsion of the diaphragm in the rotating direction of the head can be suppressed while deformation of the diaphragm in the vertical direction is restricted. Consequently, the wafer surface is uniformly polished.

Preferably, a plurality of holes are formed in the thin plate in an annular pattern as a whole, each of the holes extending from the center side in a thin-plate plane outward in the rotating direction of the head. With this feature, connecting portions between adjacent holes are flexed. Therefore, the thin plate is elastically deformable and the diaphragm is kept free to elastically expand and contract. As a result, displacements (floating) of the carrier and the retainer ring in the axial direction can be maintained to such an extent as not causing the waving deformation. Also, torsion acting upon the diaphragm in the rotating direction is reduced in a state where the wafer held on the wafer holding head is rotated while contacting the polishing pad. As a result, the wafer can be polished into a uniform surface.

Preferably, the holes are formed radially inward and outward of the third fixing device in an annular pattern as a whole on each side. With this feature, elastic deformation of the thin plate is stabilized. Therefore, elastic expansion and contraction of the diaphragm is surely maintained, and displacements of the carrier and the retainer ring in the axial direction can be maintained to such an extent as not causing the waving deformation. Also, torsion acting upon the diaphragm in the rotating direction is reduced in a state where the wafer held on the wafer holding head is rotated while contacting the polishing pad. As a result, stable polishing of the wafer can be achieved.

Preferably, the holes formed radially inward of the third fixing device are positioned above a gap between the carrier and the retainer ring, and the holes formed radially outward of the third fixing device are positioned above a gap between the retainer ring and the peripheral wall of the head body. With this feature, elastic deformation of the thin plate in areas including the holes and thereabout is maintained with stability.

Preferably, the holes are formed to have a width in the rotating direction of the head greater than a width of a connecting portion between adjacent two of the holes. With this feature, the connecting portion is easier to flex. Therefore, elastic expansion and contraction of the diaphragm is more easily maintained, and the wafer can be polished into a uniform surface under a satisfactory floating effect developed.

Preferably, the diaphragm and the thin plate are fixed to each other with a spacer interposed therebetween. With this feature, the diaphragm and the thin plate are coupled in a stabler manner, and the thin plate can be kept from deforming when it is fixed to the diaphragm.

In addition, the present invention provides a wafer manufacturing method comprising the steps of holding a wafer to be polished on a wafer holding head installed in the wafer polishing apparatus according to any one of the above-described features, and polishing the wafer while the wafer is pressed against a polishing pad, thereby manufacturing a polished wafer. With the method, the wafer is polished under a condition of suppressing both the waving deformation and the torsion acting upon the diaphragm in the rotating direction. As a result, the polished surface of the wafer can be finished uniform.

DESCRIPTION OF THE PREFERRED EMBODIMENTS

Figure 1:
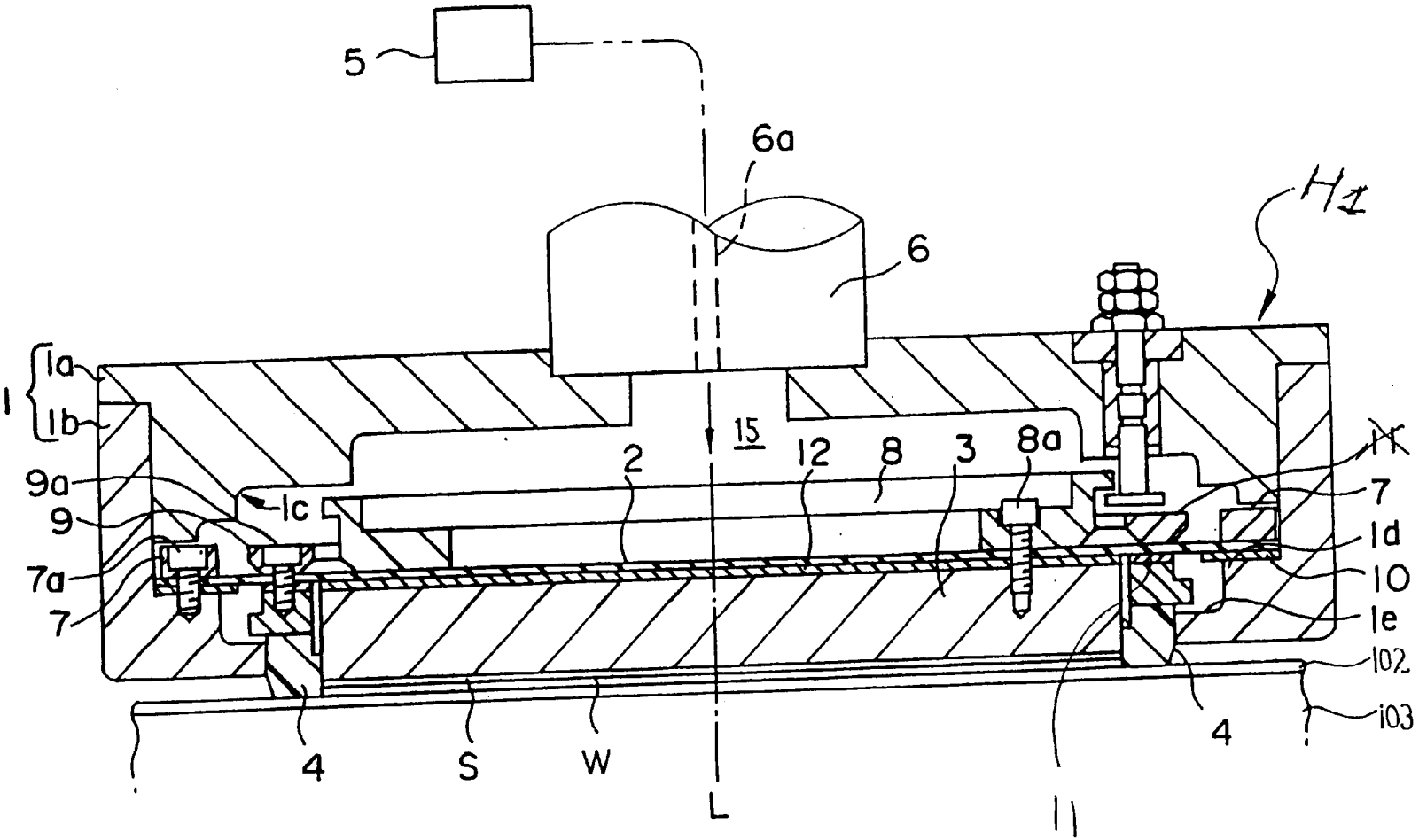
FIG. 1 is a side sectional view of a wafer holding head, showing a first embodiment of a wafer polishing apparatus of the present invention.
Figure 2:
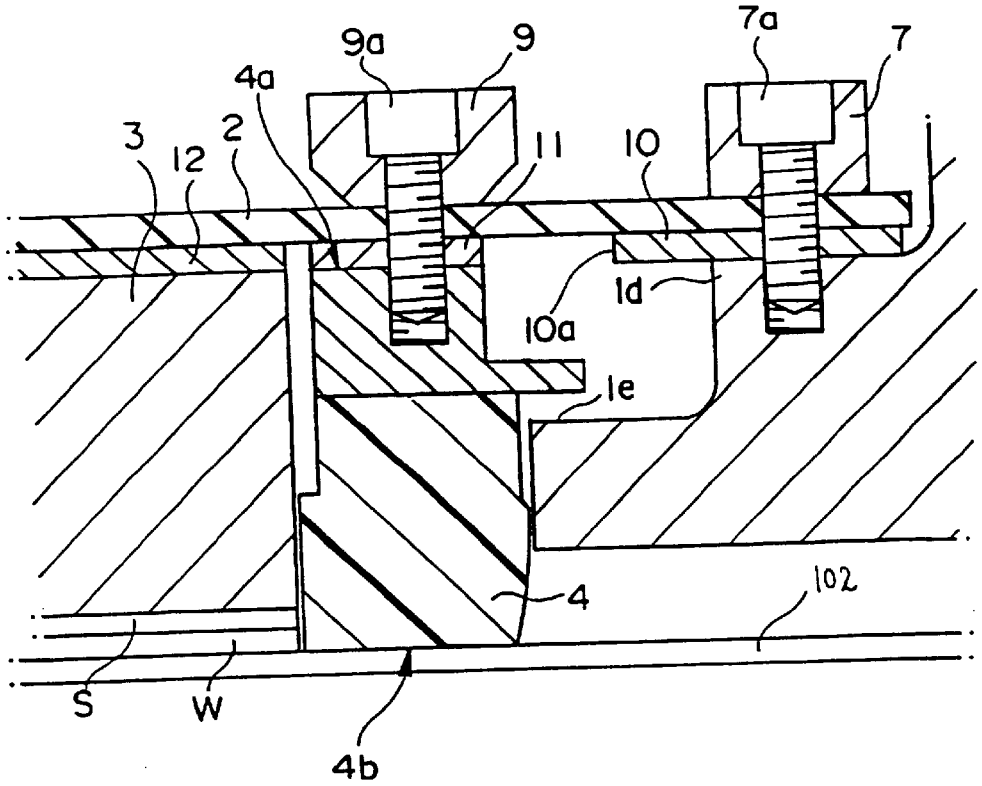
FIG. 2 is an enlarged view of principal part about a retainer ring shown in FIG. 1.

Hereinbelow, a wafer polishing apparatus and a wafer manufacturing method according to a first embodiment of the present invention will be described with reference to the drawings. FIG. 1 is a side sectional view of a wafer holding head, showing the first embodiment of the wafer polishing apparatus of the present invention. FIG. 2 is an enlarged view of principal part about a retainer ring.

Figure 11:
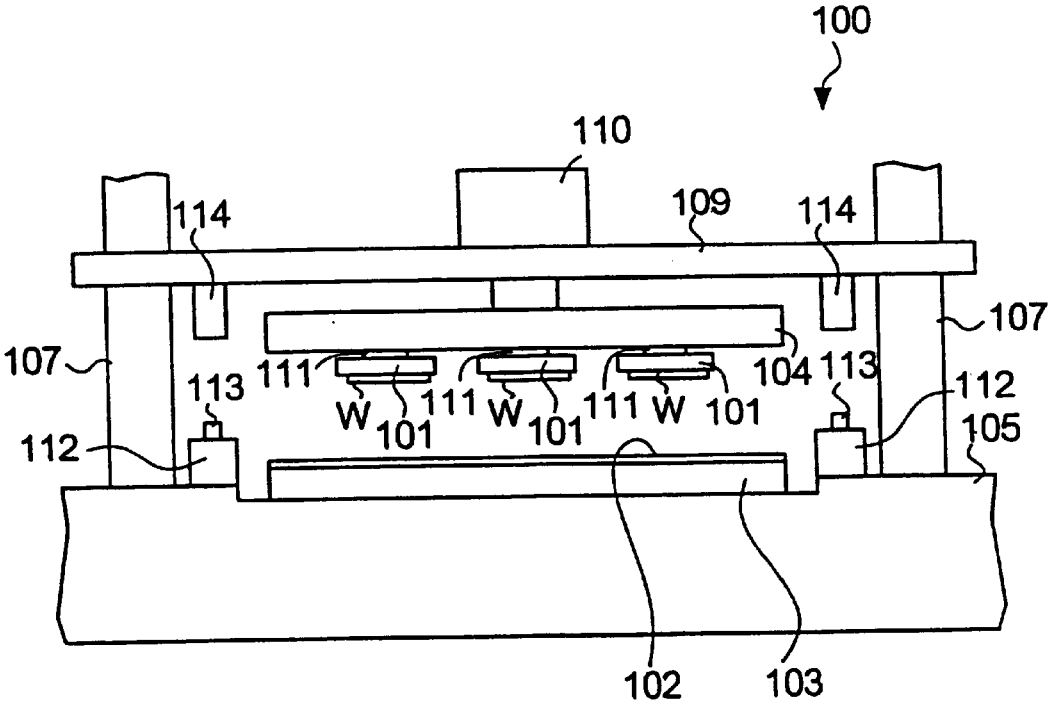
Fig. 11 PRIOR ART
FIG. 11 is a schematic view for explaining the entirety of a typical wafer polishing apparatus.
Figure 12:
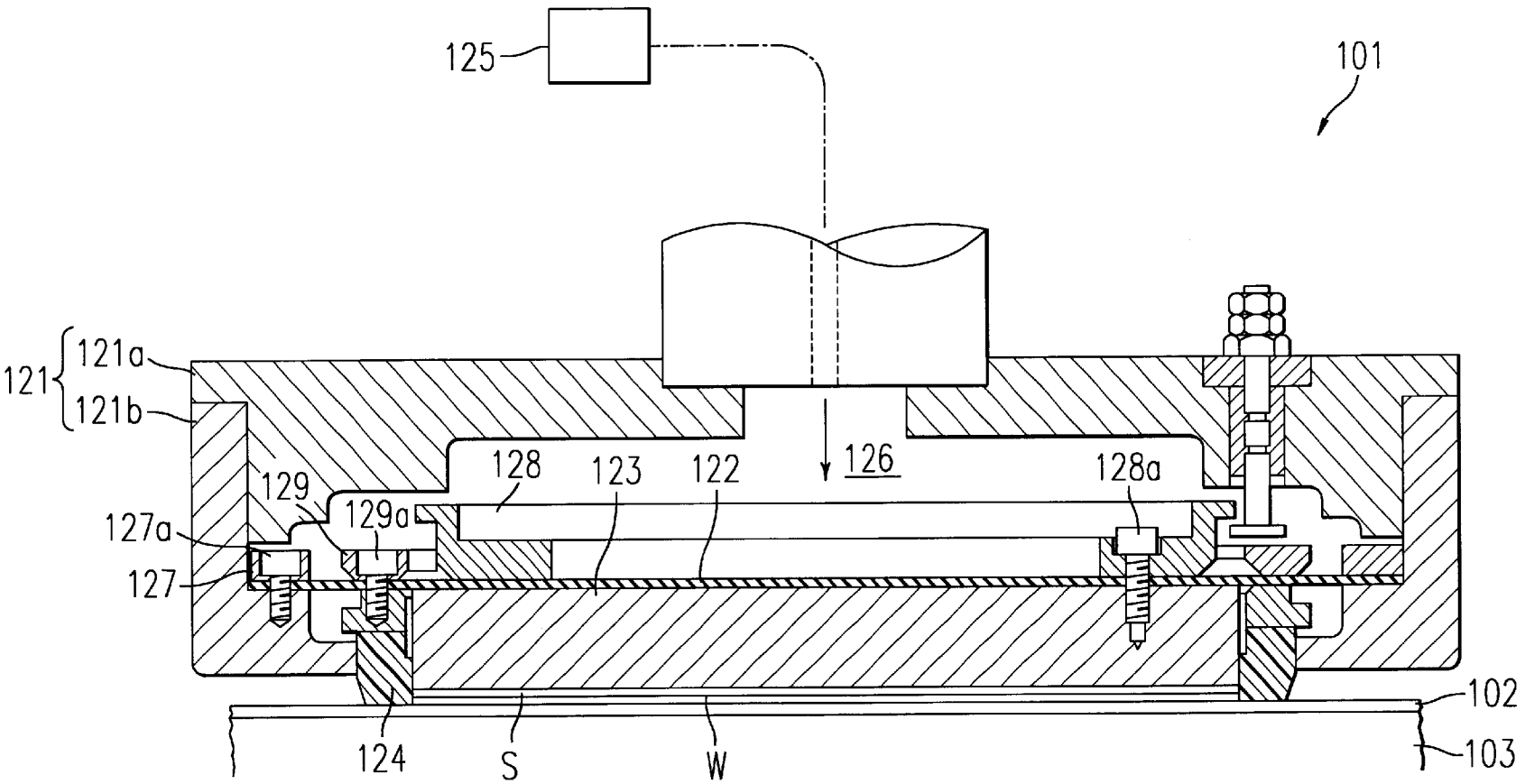
FIG. 12 PRIOR ART
FIG. 12 is a side sectional view of a conventional wafer holding head.
Figure 13:
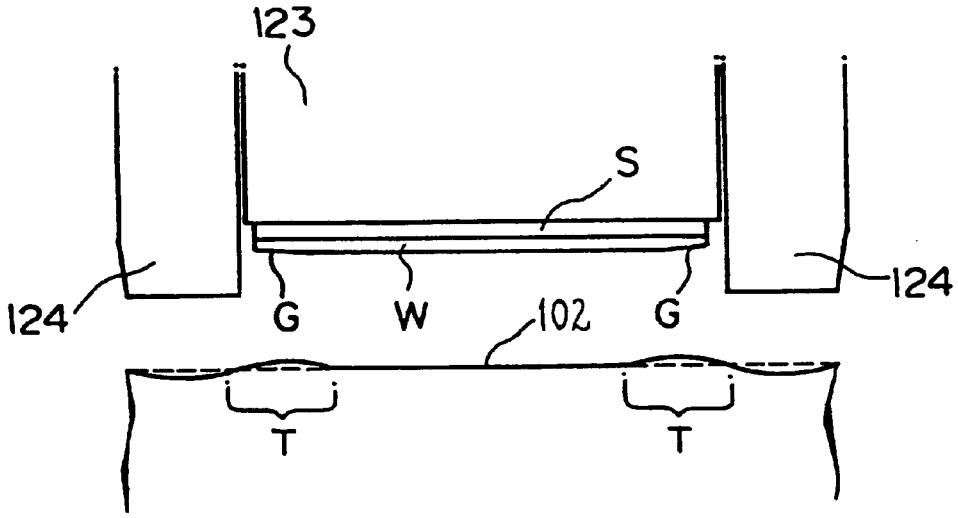
Fig. 13 PRIOR ART
FIG. 13 is an illustration for explaining a problem in the conventional wafer holding head.

An illustrated wafer holding head H1 is mounted to, for example, the carousel 104 shown in FIG. 11.

Referring to FIGS. 1 and 2, the wafer holding head Hi comprise a head body 1 made up of a top plate la and a tubular peripheral wall 1*b*; a diaphragm 2 stretched inside the head body 1 perpendicularly to a head axis L; a carrier 3 fixed to a lower surface of the diaphragm 2 and being able to hold a wafer W to be polished on the underside thereof; and a retainer ring 4 disposed between an outer periphery of the carrier 3 and the peripheral wall 1*b* in concentric relation to the peripheral wall 1*b*.

Further, a fluid chamber 15 is defined between the head body 1 and the diaphragm 2, and a pressure regulating mechanism 5 is connected to the fluid chamber 15. The pressure regulating mechanism 5 supplies pressurized air (fluid) to the fluid chamber 15 for regulating the pressure in the fluid chamber 15, thereby deforming the diaphragm 2 in the direction of the head axis L.

The head body 1 is made up of the top plate 1*a* in the form of a disk and the tubular peripheral wall 1*b* disposed under an outer periphery of the top plate la so as to extend downward therefrom. A recess 1*c* having a circular opening is formed in a lower surface of the top plate 1*a*. The top plate 1*a* is coaxially fixed to a shaft 6 which is coupled to the carousel 104, and a flow passage 6*a* communicating with the pressure regulating mechanism 5 is formed to extend through the shaft 6. A step portion 1*d* is formed at a lower end of the peripheral wall 1*b* to project radially inward throughout its circumference, and an annular ledge portion 1*e* is formed below the step portion 1*d* to project radially inward from it.

The diaphragm 2 is in the form of a disk made of an elastic material such as fiber-reinforced rubber, and is placed on the step portion 1*d* of the peripheral wall 1*b*. The diaphragm 2 is held between the step portion 1*d* and a diaphragm fixing ring 7, and is fixed to the head body 1 by screws 7*a* tightened into the step portion 1*d* from above the diaphragm fixing ring 7. In a fixed state, the diaphragm 2 is stretched so as to cover or close the recess 1*c*.

The carrier 3 is in the form of a disk having a certain thickness and made of a high-rigidity material such as a ceramic. The carrier 3 is disposed in contact with the lower surface of the diaphragm 2 in concentric relation to the head body 1. A carrier fixing ring 8 is disposed on the upper side of the diaphragm 2 with the diaphragm 2 held between the carrier 3 and the carrier fixing ring 8. The carrier 3 is fixed to the diaphragm 2 by screws 8*a* tightened into the carrier 3 from above the carrier fixing ring 8. A wafer attraction sheet S is bonded to a lower surface of the carrier 3 for attracting and holding the wafer W to be polished. The wafer attraction sheet S is made of a material having a water absorbing property, such as unwoven cloth, and attracts the wafer with surface tension developed when it absorbs water.

As shown in FIG. 2, the retainer ring 4 is fitted to a circular groove defined between the annular peripheral wall 1*b* and the outer periphery of the carrier 3 such that the retainer ring 4 is positioned in concentric relation to the peripheral wall 1*b* and the carrier 3 while small gaps are left relative to both an inner surface of the peripheral wall 1*b* and an outer peripheral surface of the carrier 3. Further, a retainer-ring fixing ring 9 is disposed on the upper side of the diaphragm 2 with the diaphragm 2 held between the retainer ring 4 and the retainer-ring fixing ring 9. The retainer ring 4 is fixed to the diaphragm 2 by screws 9*a* tightened into the retainer ring 4 from above the retainer-ring fixing ring 9.

The retainer ring 4 is of a two-piece structure comprising a metal-made upper portion into which the screws 9*a* are tightened, and a resin-made lower portion which is brought into contact with a polishing pad 102. The retainer ring 4 has an upper end surface 4*a* for holding the diaphragm 2 between itself and the retainer-ring fixing ring 9, and has a lower end surface 4*b* brought into contact with the polishing pad 102. Both the upper and lower end surfaces 4*a*, 4*b* are formed to be flat perpendicularly to the head axis L in a state where the retainer ring 4 is attached to the wafer holding head H1.

An annular thin plate (spacer) 10 is disposed in concentric relation to the peripheral wall 1*b*, and is interposed between the step portion 1*d* formed at the lower end of the peripheral wall 1*b* and the diaphragm 2 placed on the step portion 1*d*. The thin plate 10 is fixedly screwed in place together with the diaphragm 2. An inner peripheral edge of the thin plate 10 projects radially inward of the step portion 1*d* of the peripheral wall 1*b* along the lower surface of the diaphragm 2 to form a flange portion 10*a*. Thus, the diaphragm 2 has a deformable area smaller than that in the case of the thin plate 10 not being interposed.

Also, between the retainer ring 4 and the diaphragm 2, an annular thin plate 11 is interposed in concentric relation to the peripheral wall 1*b* and is fixedly screwed to the diaphragm 2 together with the retainer ring 4. Further, between the carrier 3 and the diaphragm 2, a disk-shaped thin plate 12 is interposed in concentric relation to the peripheral wall 1*b* and is fixedly screwed to the diaphragm 2 together with the carrier 3.

The thin plates 11, 12 serve to compensate for a difference in set level between the retainer ring 4 and the carrier 3 which occurs due to the provision of the thin plate 10. If thicknesses of the retainer ring 4 and the carrier 3 are increased in amount corresponding to the thickness of the thin plate 10 beforehand, the thin plates 11, 12 can be dispensed with.

In manufacturing of wafers, the wafer W is polished by the polishing apparatus including the above-described wafer holding head H1 as follows. First, the wafer W is stuck to the wafer attraction sheet S so as to locate in imbedded fashion within the retainer ring 4. Then, the surface of the wafer W exposed to face downward is brought into contact with the polishing pad 102 bonded to the upper surface of a platen 103, and is polished under rotation of the wafer holding head H1 while a slurry containing a polishing abrasive is supplied. A material of the polishing pad 102 may be any of the materials that have been conventionally used for polishing wafers. Examples of usable materials include a velours type pad formed by impregnating a soft resin such as a polyurethane resin in unwoven cloth made of polyester or the like; a suede type pad formed by coating a foamed resin layer made of foamed polyurethane, for example, on a base material comprising unwoven cloth made of polyester or the like; and a foamed resin sheet made of independently foamed polyurethane or the like.

In the above operation, since the carrier 3 and the retainer ring 4 are supported by a floating structure, they are independently displaced in the vertical direction with elastic deformation of the diaphragm 2 and are pressed toward the polishing pad 102. Pressing forces acting upon the carrier 3 and the retainer ring 4 are proportional to a pressure bearing area of the diaphragm 2 which is elastically deformed with the fluid pressure. However, the diaphragm 2 is elastically deformable in an area stretched inside the head body 1, and pressure bearing areas of the carrier 3 and the retainer ring 4 are distributed in accordance with respective areas of their portions fixed to the diaphragm 2.

Figure 3A:
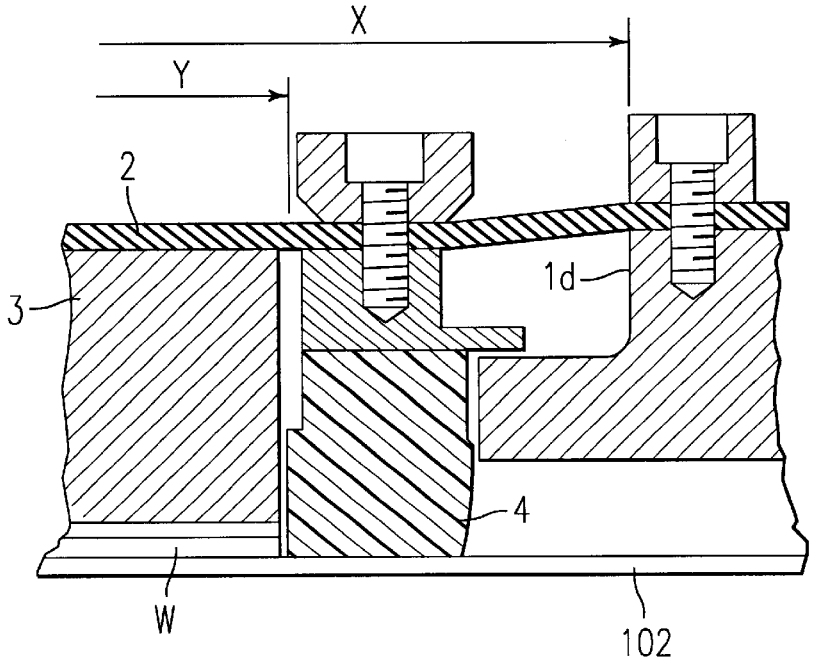
FIGS. 3A and 3B are enlarged views for explaining states of displacement of the retainer ring.

More specifically, it is here assumed that the distance from the head axis L to the step portion 1*d* is X, the distance from the head axis L to the gap between the carrier 3 and the retainer ring 4 is Y, and the pressure in the fluid chamber 15 is P. Where the spacer 10 is not interposed as shown in FIG. 3A, the pressure bearing area of the diaphragm 2 which takes part in developing a force acting to press the retainer ring 4 downward with the pressure P is given by a portion contained in an area width x - Y.

Figure 3B:
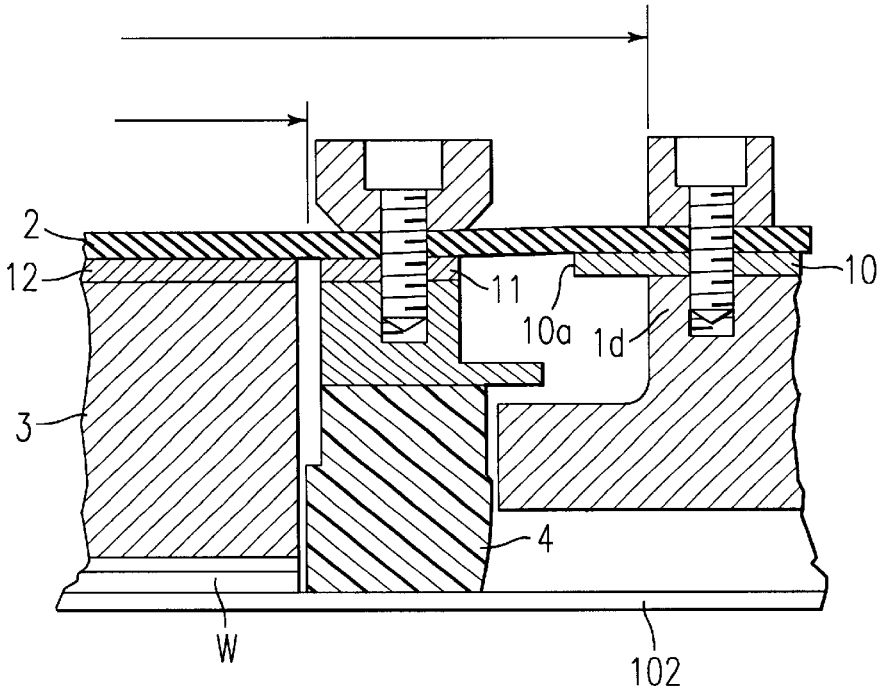

On the other hand, where the spacer 10 is interposed as shown in FIG. 3B, the pressure bearing area of the diaphragm 2 which takes part in developing a force acting to press the retainer ring 4 downward with the pressure P is given by a portion contained in an area width (X−K)−Y on an assumption that the width by which the flange portion 10*a* projects radially inward from the step portion 1*d* is K. Accordingly, it is understood that the provision of the spacer 10 reduces the pressure bearing area of the diaphragm 2, which takes part in developing a force acting to press the retainer ring 4 downward, by an amount corresponding to the projection width K of the flange portion 10*a*.

Because the levels of the retainer ring 4 and the step portion 1*d* are usually adjusted so as to position the retainer ring 4 at a lower level and a downward pressing force is imposed on the diaphragm 2 at all times, the above-mentioned effect of reducing the relevant pressure bearing area just by restricting downward deformation of the diaphragm 2 can be obtained. In addition, by placing another thin plate, which has the same projection width as that of the lower thin plate 10, on the upper side of the diaphragm 2 and restricting deformation of the diaphragm 2 in both the up and down directions, the effect of reducing the force pressing the retainer ring 4 downward can be obtained with stability even when the diaphragm 2 is accidentally displaced upward.

Thus, the provision of the thin plate 10 makes it possible to reduce only the pressure bearing area of the diaphragm 2 associated with the retainer ring 4 and to reduce the pressing force acting only from the retainer ring 4 to the polishing pad 102 while the pressure bearing area of the diaphragm 2 associated with the carrier 3 is kept unchanged. As a result, the polishing pad 102 can be prevented from causing waving deformation, and the wafer W can be prevented from being excessively polished at its outer peripheral edge.

Moreover, by preparing several types of thin plates 10 having different projection widths K and selectively employing a suitable one of the thin plates 10 depending on the material of the polishing pad 102 and other conditions, versatility of the wafer holding head H1 can be improved.

Figure 4:
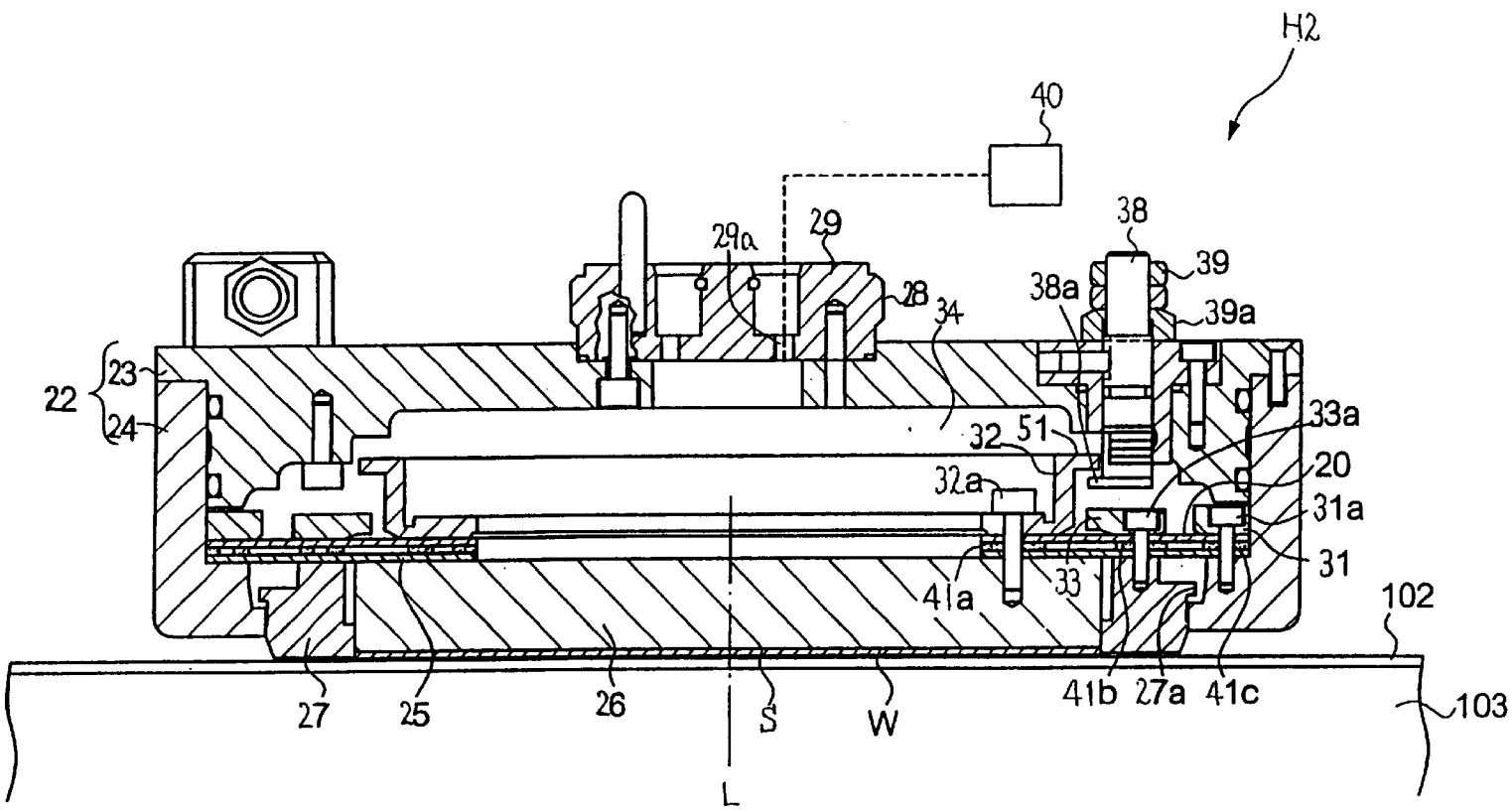
FIG. 4 is a side sectional view of a wafer holding head, showing a second embodiment of the wafer polishing apparatus of the present invention.
Figure 5:
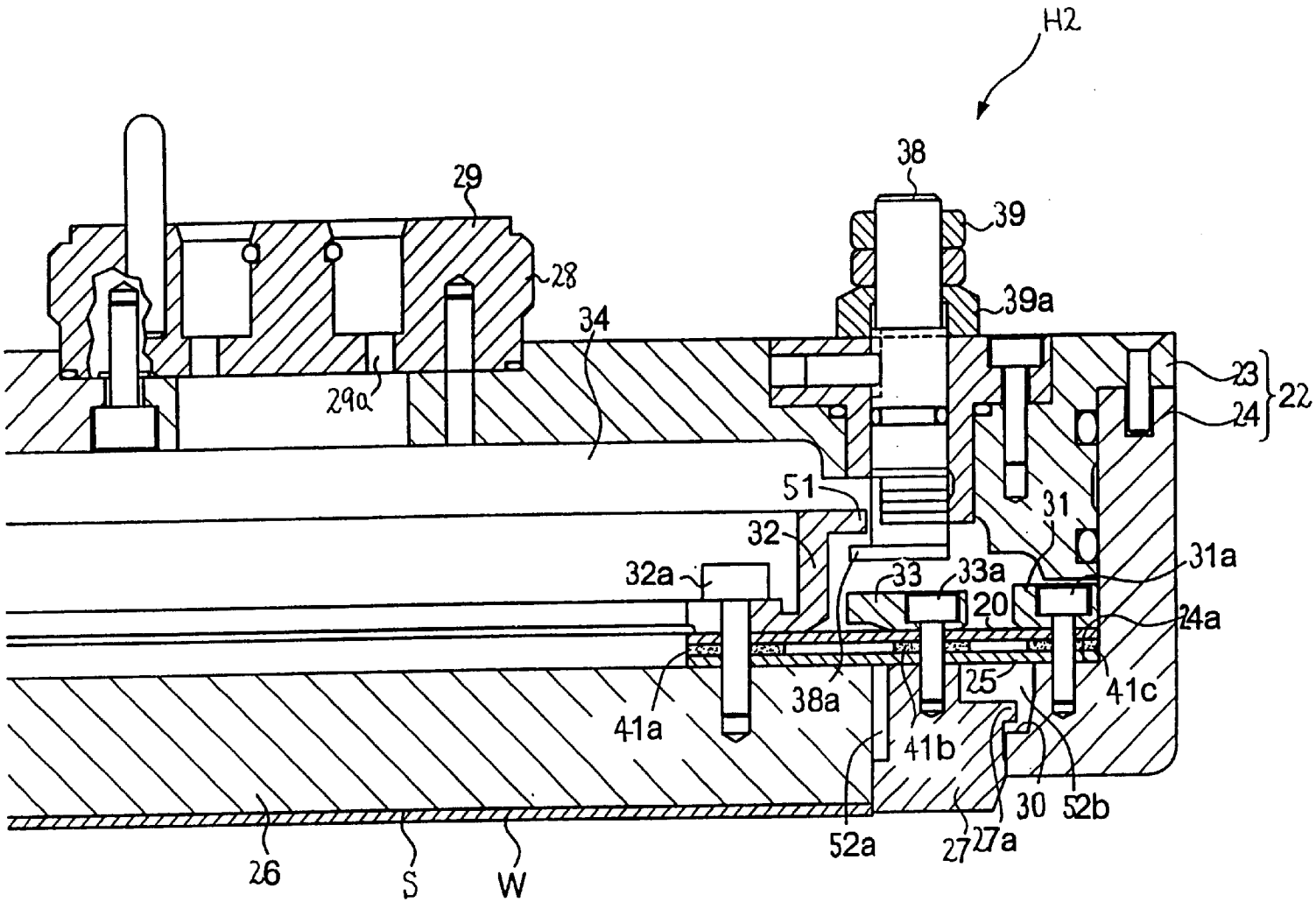
FIG. 5 is an enlarged view of principal part about a thin plate shown in FIG. 4.
Figure 6:
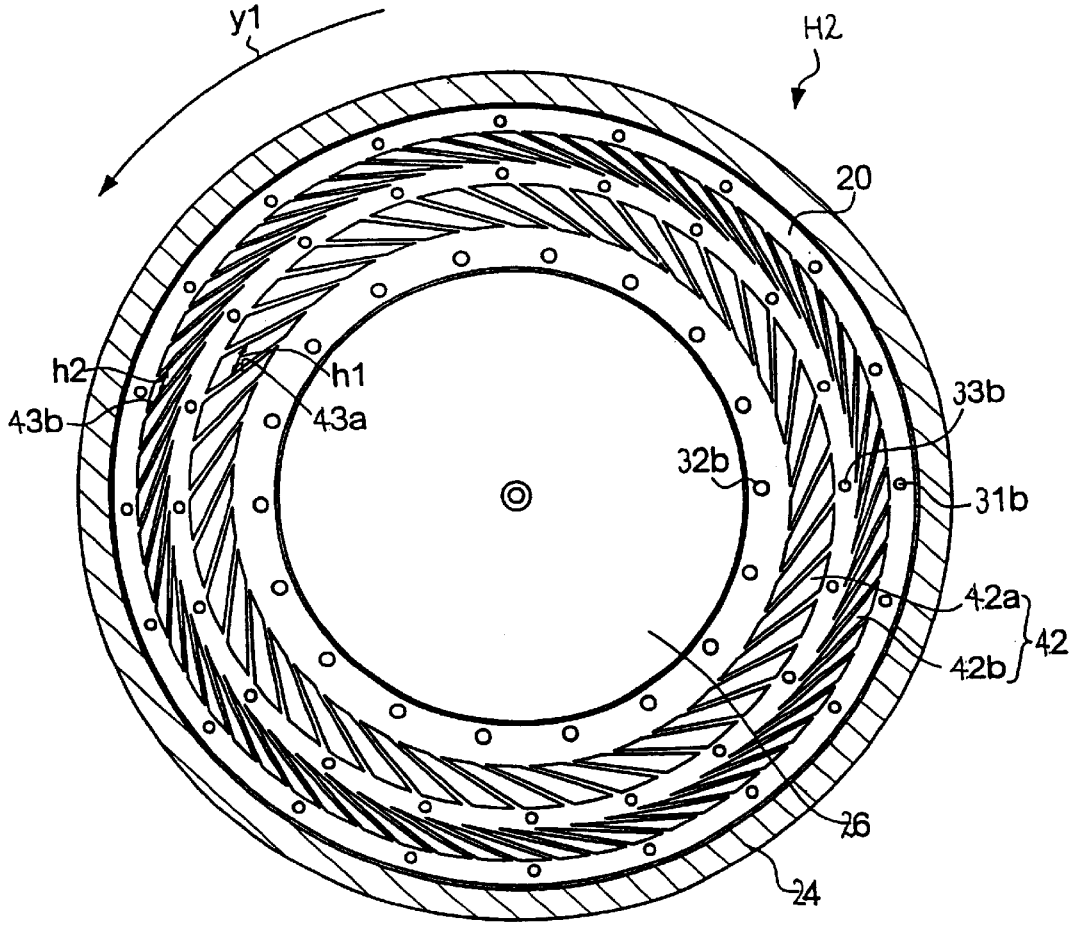
FIG. 6 is a plan view for explaining one embodiment of the thin plate.

Next, a wafer polishing apparatus and a wafer manufacturing method according to a second embodiment of the present invention will be described with reference to FIGS. 4, 5 and 6. FIG. 4 is a side sectional view of a wafer holding head H2, showing the second embodiment of the wafer polishing apparatus of the present invention. FIG. 5 is an enlarged view of principal part about a thin plate, and FIG. 6 is a plan view for explaining one embodiment of the thin plate.

Referring to FIGS. 4 and 5, the wafer holding head H2 comprises a head body 22 made up of a top plate 23 and a tubular peripheral wall 24; a diaphragm 25 made of an elastic material and stretched inside the head body 22; a disk-shaped carrier 26 fixed to a lower surface of the diaphragm 25; an annular retainer ring 27 disposed between an inner surface of the peripheral wall 24 and an outer peripheral surface of the carrier 26 in concentric relation; and an annular thin plate 20 disposed on the upper side of the diaphragm 25.

The top plate 23 is coaxially fixed to a shaft 29 which is coupled to a carousel, and a flow passage 29*a* is formed to extend through the shaft 29 in the vertical direction. A male threaded portion 28 is formed on an outer circumferential surface of the shaft 29. A step portion 24*a* is formed at a lower end of the peripheral wall 24 to project radially inward throughout its circumference, and an annular ledge portion 30 is formed below the step portion 24*a* to project radially inward from it.

The diaphragm 25 is in the form of a disk or annular plate made of an elastic material such as fiber-reinforced rubber. A fluid chamber 34 is defined above the diaphragm 25 and is communicated with the flow passage 29*a* formed to extend through the shaft 29. By supplying air or any other suitable fluid to an inner space of the fluid chamber 34 from a pressure regulating mechanism 40 via the flow passage 29*a*, the pressure in the fluid chamber 34 is regulated.

As with the first embodiment, the carrier 26 is in the form of a disk having a certain thickness and made of a high-rigidity material such as a ceramic. A wafer attraction sheet S is bonded to a lower surface of the carrier 26 for attracting and holding a wafer W to be polished. Further, the annular retainer ring 27 is disposed between the inner surface of the peripheral wall 24 and the outer peripheral surface of the carrier 26 such that the retainer ring 27 is positioned in concentric relation to the peripheral wall 24 and the carrier 26 while small gaps are left relative to both the inner surface of the peripheral wall 24 and the outer peripheral surface of the carrier 26. The retainer ring 27 has an upper end surface and a lower end surface formed to be flat.

The thin plate 20 disposed on the upper side of the diaphragm 25 is made of a rigid material such as stainless steel, for example, and has an annular shape. An inner peripheral portion of the thin plate 20 is fixed to the carrier 26 by a carrier fixing ring 32 and screws 32*a*, which serve as fixing means, with the diaphragm 25 held between the thin plate 20 and the carrier 26. In addition, a carrier spacer 41*a* is interposed between the diaphragm 25 and the thin plate 20 to prevent deformation of the thin plate 20 which could occur when the thin plate 20 is directly attached to the upper surface of the diaphragm 25.

Likewise, a radial intermediate portion of the thin plate 20 is fixed the retainer ring 27 by a retainer-ring fixing ring 33 and screws 33*a*, which serve as fixing means, with the diaphragm 25 held between the thin plate 20 and the retainer ring 27. Also, an outer peripheral portion of the thin plate 20 is fixed to the step portion 24*a* on the inner surface of the peripheral wall 24 by a diaphragm fixing ring 31 and screws 31*a*, which serve as fixing means, with the diaphragm 25 held between the thin plate 20 and the step portion 24*a*. In addition, a retainer ring spacer 41*b* and a head body spacer 41*c* are interposed respectively between the diaphragm 25 and the radial intermediate portion and the outer peripheral portion of the thin plate 20 at which the thin plate 20 is fixed respectively by the retainer ring fixing screws 33*a* and the diaphragm fixing screws 31*a*, thereby preventing deformation of the thin plate 20 which could occur when the thin plate 20 is directly attached to the upper surface of the diaphragm 25.

An annular step portion 51 is formed at an upper end of the carrier fixing ring 32, and is positioned to be engageable with a step portion 38*a* formed at a lower end of a stopper bolt 38 which is vertically inserted downward from above the top plate 23 and fixed in place by a nut 39 and a spacer 39*a*. Therefore, even when the diaphragm 25 is flexed downward due to the dead weight of the carrier 26 and the pressure in the fluid chamber 34 upon the wafer holding head H2 being elevated by, e.g., a hoisting and lowering mechanism, the diaphragm 25 is avoided from undergoing excessive forces because of engagement between the step portion 51 and the step portion 38*a*.

A step portion 27*a* is formed on an outer peripheral surface of the retainer ring 27 and is positioned to be engageable with the ledge portion 30. Therefore, even when the diaphragm 25 is locally flexed downward due to the dead weight of retainer ring 27 and the pressure in the fluid chamber 34 upon the wafer holding head H2 being elevated by the hoisting and lowering mechanism, the diaphragm 25 is avoided from undergoing excessive forces because of engagement between the step portion 27*a* and the ledge portion 30.

Moreover, the carrier 26 and the retainer ring 27 are each supported by a floating structure such that they are independently movable in the direction of the head axis L with elastic deformation of the diaphragm 25.

As shown in FIG. 6, the thin plate 20 is in the annular form, and has a plurality of holes 42 which are formed in an annual pattern as a whole, each of the holes 42 extending from the center side in a thin-plate plane outward in the rotating direction of the thin plate 20 (or the wafer holding head H2). The holes 42 comprise inner holes 42*a* formed in an annual pattern as a whole to position radially inward of holes 33*b* for the retainer-ring fixing screws 33*a* by which the thin plate 20 is fixed to the retainer ring 27, i.e., to position between holes 33*b* for the retainer-ring fixing screws 33*a* and holes 32*b* for the carrier fixing screws 32*a*; and outer holes 42*b* formed in an annual pattern as a whole to position radially outward of the holes 33*b* for the retainer-ring fixing screws 33*a*, i.e., to position between the holes 33*b* for the retainer-ring fixing screws 33*a* and holes 31*b* for the diaphragm fixing screws 31*a*.

Further, the inner holes 42*a* are positioned substantially above a gap 52*a*, shown in FIG. 5, between the carrier 26 and the retainer ring 27, whereas the outer holes 42*b* are positioned substantially above a gap 52*b*, shown in FIG. 5, between the retainer ring 27 and the peripheral wall 24.

The inner holes 42*a* each have substantially a rectangular shape being elongate in the rotating direction of the wafer holding head H2 indicated by an arrow y1. Also, the inner holes 42*a* are formed with equal angular intervals such that a connecting portion 43*a* between the adjacent holes 42*a* has a width smaller than a width h1 of each hole 42*a* in the rotating direction.

On the other hand, the outer holes 42*b* each have substantially a slender triangular shape being elongate in the rotating direction of the wafer holding head H2 indicated by the arrow y1. One end of the triangular shape corresponding to the apex is positioned on the radially inner side, and the other end of the triangular shape corresponding to the base is positioned on the radially outer side. Also, the outer holes 42*b* are formed with equal angular intervals such that a connecting portion 43*b* between the adjacent holes 42*b* has a width smaller than a width h2 of each hole 42*b* in the rotating direction.

The wafer holding head H2 having the above-described construction is coupled to the carousel by screwing the male threaded portion 28 to the spindle 29. The wafer W is polished by using the wafer holding head H2 as follows. First, the wafer W is stuck to the wafer attraction sheet S bonded to the lower surface of the carrier 26. Then, the surface of the wafer W exposed to face downward is brought into contact with the polishing pad 102 bonded to the upper surface of a platen 103 while the wafer w is retained at its outer periphery by the retainer ring 27.

Subsequently, air or any other suitable fluid is supplied to the flow passage 29*a* from a pressure regulating mechanism 40. The supplied fluid flows into the fluid chamber 34 to regulate the pressure in the fluid chamber 34. The carrier 26 and the retainer ring 27 are supported on the diaphragm 25 with a floating structure such that they are independently displaced in the vertical direction. Pressing forces acting against the polishing pad 102 from the carrier 26 and the retainer ring 27 can be adjusted depending on the pressure in the fluid chamber 34.

In the above operation, since the thin plate 20 has the inner holes 42*a* and the outer holes 42*b* which are arranged in an annular pattern as a whole and are positioned respectively above the gap 52a between the carrier 26 and the retainer ring 27 and above the gap 52*b* between the retainer ring 27 and the peripheral wall 24 of the head body 22, the thin plate 20 is elastically deformable in the direction of the head axis L. Hence, flexing of the carrier 26 and the retainer ring 27 fixed to the diaphragm 25 in the direction of the head axis L, i.e., a floating effect given to by them, is not impeded.

Further, since the inner holes 42*a* and the outer holes 42*b* are formed to have the widths h1, h2 in the rotating direction greater than the widths of the connecting portions 43*a*, 43*b* between the respective adjacent holes, elastic deformation of the thin plate 20 in the direction of the head axis L can be more easily realized. Therefore, a stable floating effect can be provided to each of the carrier 26 and the retainer ring 27.

Then, the platen 103 is rotated and the wafer holding head H2 is rotated in planetary fashion while the pressing forces imposed against the polishing pad 102 from the carrier 26 and the retainer ring 27 are adjusted. At the same time, a polishing abrasive is supplied from a polishing abrasive supply means (not shown) is supplied to the surface of the polishing pad 102 and to the polished surface of the wafer W, thereby polishing the wafer W.

When the wafer W is polished on condition that the in-plane speed is not uniform, a speed difference between the polished wafer W and the polishing pad 102 is not constant in the wafer plane, i.e., the plane in which the wafer W is located. Therefore, rotating forces are imposed on not only the carrier 26 holding the wafer W, but also the retainer ring 27. Correspondingly, the diaphragm 25 is twisted relative to the head body 22, but the torsion acting upon the diaphragm 25 is reduced by the presence of the thin plate 20 which is fixed to the carrier 26, the retainer ring 27 and the peripheral wall 24 of the head body 22.

In addition, since the inner holes 42*a* and the outer holes 42*b* are formed to be elongate outward from the center side in the rotating direction of the wafer holding head H2, the torsion acting upon the diaphragm 25 can be surely suppressed even when the wafer holding head H2 is forced to rotate.

Thus, with this embodiment, the annular thin plate 20 is disposed on the upper surface of the diaphragm 25, and the thin plate 20 is fixed to the carrier 26, the retainer ring 27 and the peripheral wall 24 of the head body 22. Accordingly, the torsion acting upon the diaphragm 25 in the rotating direction is suppressed by the thin plate 20 and the wafer W is polished with stability.

Since the holes 42 are formed in the thin plate 20 in an annular pattern as a whole so as to provide a bridging structure, the thin plate 20 is elastically deformable in the direction of the head axis L. Therefore, the carrier 26 and the retainer ring 27 fixed to the diaphragm 25 are allowed to flex in the direction of the head axis L.

On the other hand, during rotation of the wafer holding head H2, the torsion acting upon the diaphragm 25 in the rotating direction is reduced and stable polishing of the wafer W can be achieved.

Further, since the inner holes 42*a* and the outer holes 42*b* are formed to have the widths h1, h2 in the rotating direction greater than the widths of the connecting portions 43*a*, 43*b* between the respective adjacent holes, elastic deformation of the thin plate 20 in the direction of the head axis L can be more easily realized. In other words, by increasing an area occupied by the holes 42 with respect to the overall area of the thin plate 20 to such an extent that the effect of suppressing torsion of the diaphragm 25 is not impaired, the floating effect of the carrier 26 and the retainer ring 27 both fixed to the diaphragm 25 can be developed with stability, and highly accurate polishing of the wafer W can be achieved.

Figure 7:
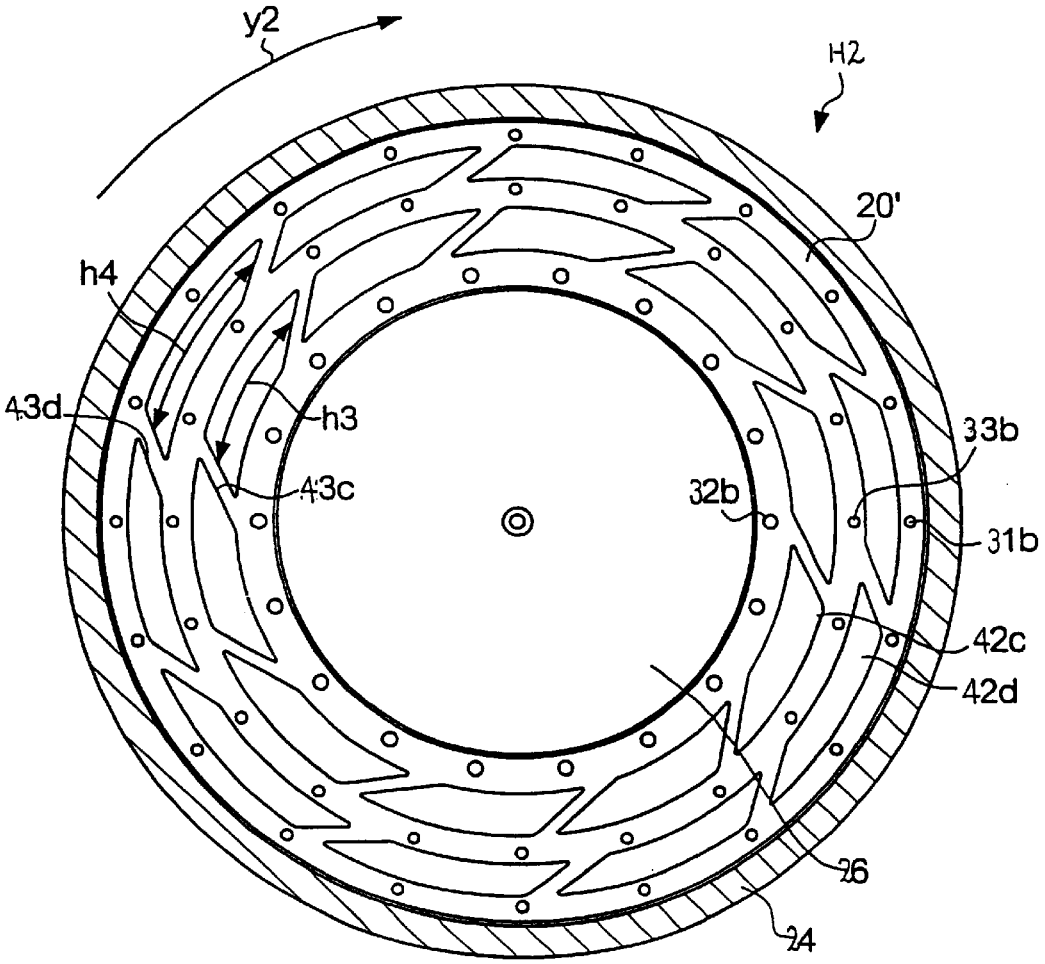
FIG. 7 is a plan view for explaining another embodiment of the thin plate.

The holes 42 in the thin plate 20 may be formed as shown in FIG. 7. More specifically, in a thin plate 20' shown in FIG. 7, inner holes 42*c* and outer holes 42*d* have widths h3, h4 in the rotating direction greater than the widths h1, h2 of the inner and outer holes 42*a*, 42*b* in the thin plate 20 shown in FIG. 6. Further, the inner and outer holes 42*c*, 42*d* are formed to extend radially outward from the center side of the thin plate 20' in the rotating direction of the wafer holding head H2 (indicated by an arrow y2). In other words, the holes 42*c*, 42*d* are each substantially in the form of a parallelogram with short sides spaced from each other in the rotating direction of the wafer holding head H2. Moreover, the inner and outer holes 42*c*, 42*d* are formed to have the widths h3, h4 in the rotating direction greater than the widths of connecting portions 43*c*, 43*d* between the respective adjacent holes.

Thus, a similar advantage as described above can also be obtained even when the number and size of the holes formed in the thin plate are changed.

It is to be noted that the wafer W may be polished while measuring polishing resistance by a sensor, such as a strain gauge, attached to the thin plate 20 (20').

Next, a description will be made of the fact that the wafer polishing apparatus of the present invention enables preferential polishing of an outer peripheral area of the wafer under the in-plane non-uniform condition, which has not been realized in the related art, with reference to FIG. 8, 9 and 10. In each of graphs shown in FIG. 8, 9 and 10, the vertical axis represents a polishing rate of the wafer W, and the horizontal axis represents a distance from the center of the wafer W.

Also, a conventional wafer holding head means a wafer holding head having the same construction as the wafer holding head H2 according to the present invention except for the thin plate 20.

Figure 8A:
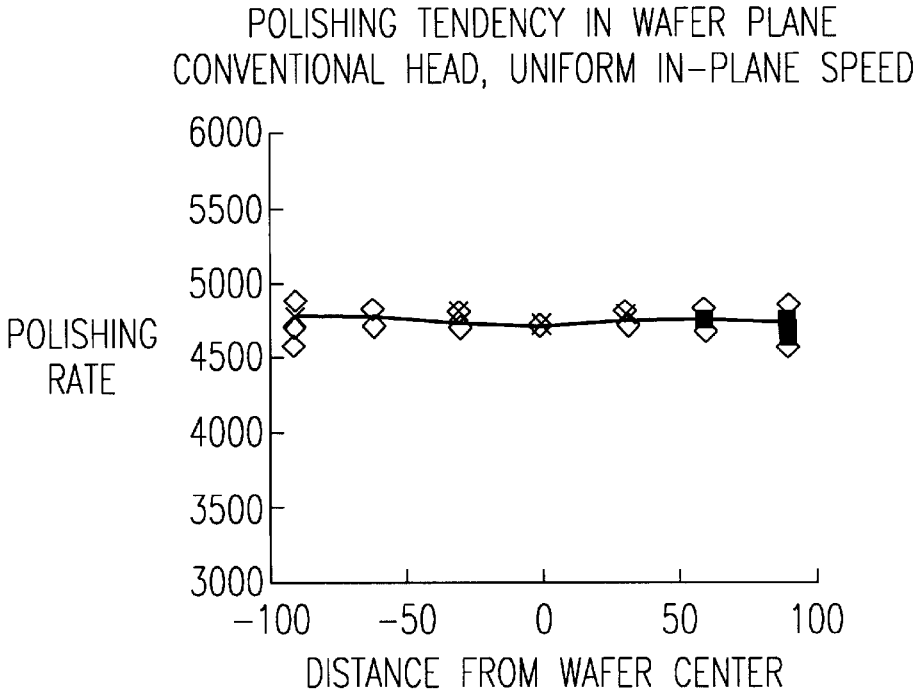
FIGS. 8A and 8B are graphs for explaining results obtained when polishing a wafer with a wafer holding head for a wafer polishing apparatus according to the related art.
Figure 8B:
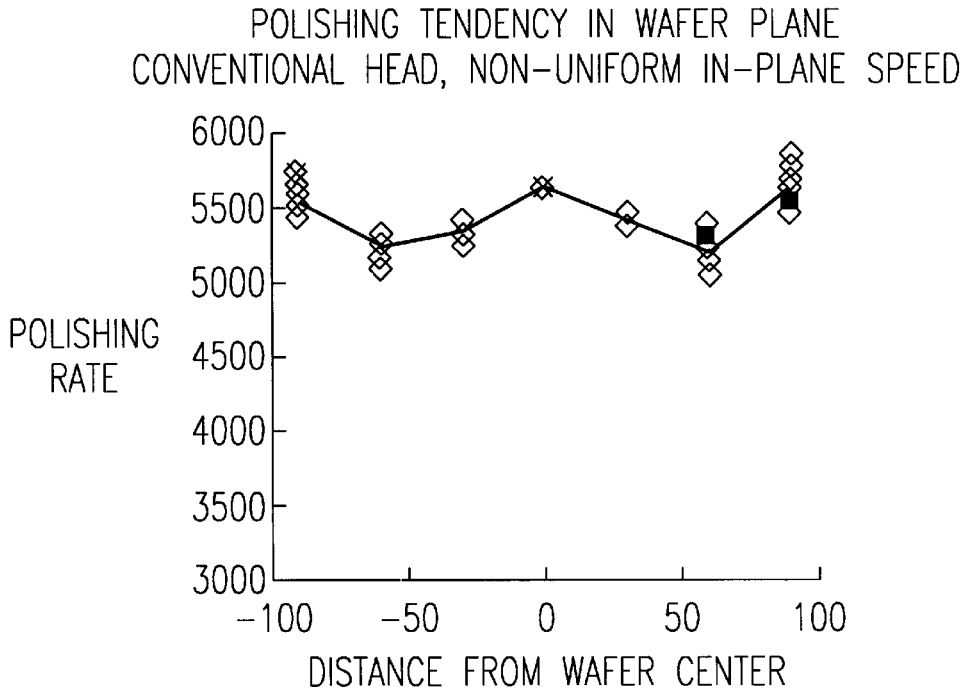

FIGS. 8A and 8B show experimental results obtained when polishing the wafer W with the conventional wafer holding head. Under the in-plane speed uniform condition, as shown in FIG. 8A, the wafer W can be uniformly polished. When polishing the wafer W under the in-plane speed non-uniform condition, it is expected based on the consideration that only an outer peripheral area of the wafer W is preferentially polished. In practice, however, the wafer W is overly polished in both an outer peripheral area and a central area thereof as shown in FIG. 8B, and a desired polished surface cannot be obtained.

Figure 9A:
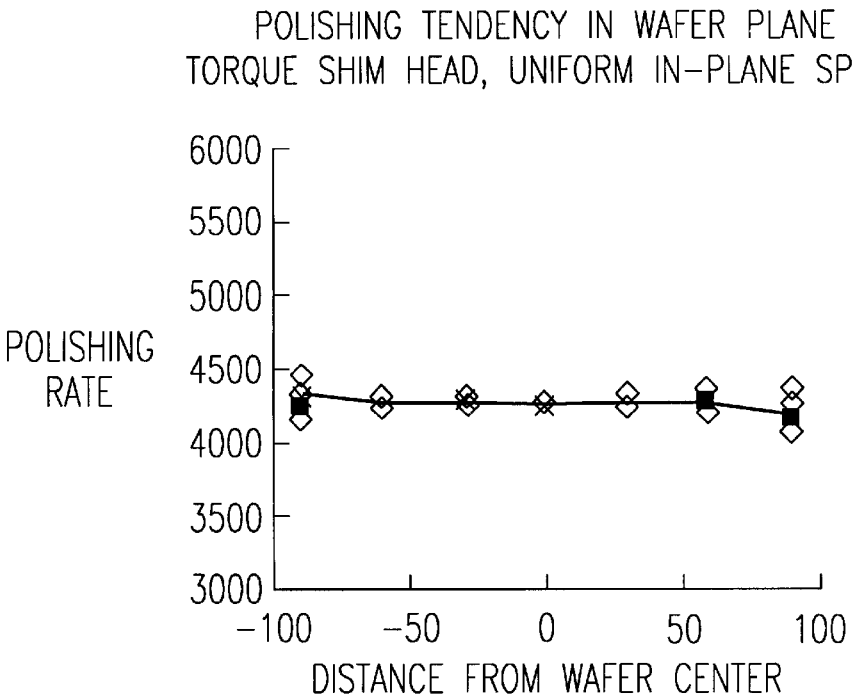
FIGS. 9A and 9B are graphs for explaining results obtained when polishing a wafer with the wafer holding head for the wafer polishing apparatus according to the present invention.
Figure 9B:
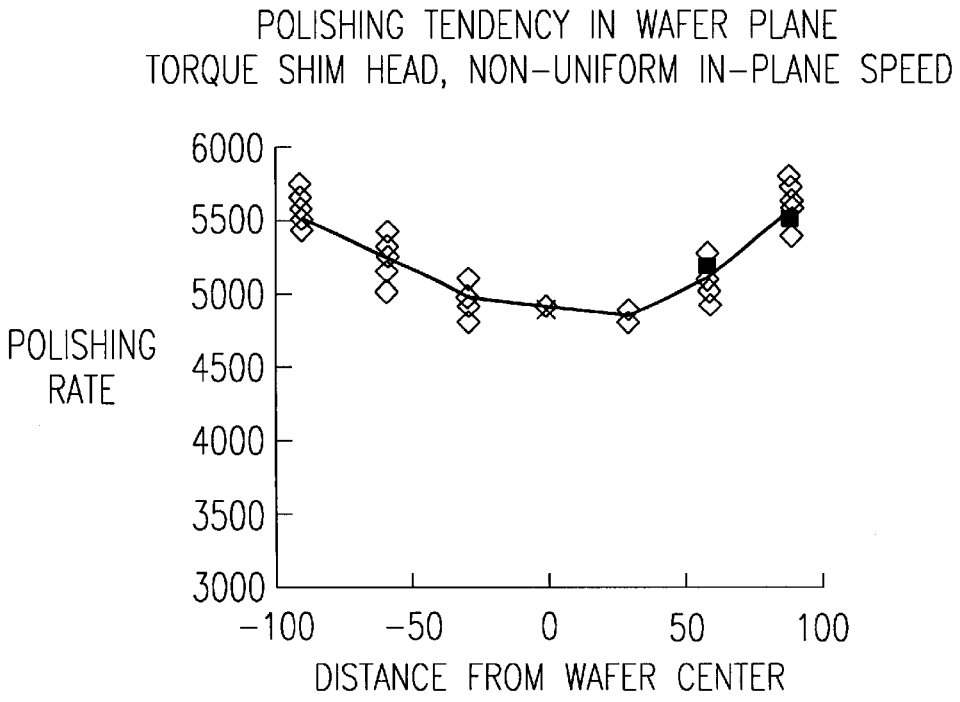

FIGS. 9A and 9B show experimental results obtained when polishing the wafer W with the wafer holding head (torque shim head) including the thin plate 20 mounted in place. Under the in-plane speed uniform condition, as shown in FIG. 9A, the wafer W can be uniformly polished in conformity with theory as with the case of employing the wafer holding head not provided with the thin plate 20. Further, when polishing the wafer W under the in-plane speed non-uniform condition with the thin sheet 20 mounted in place, it has proved as shown in FIG. 9B that only the outer peripheral area of the wafer W is preferentially polished as expected based on the consideration. This means that torsion of the diaphragm is suppressed by the provision of the thin plate 20 and hence polishing has been stabilized.

Figure 10A:
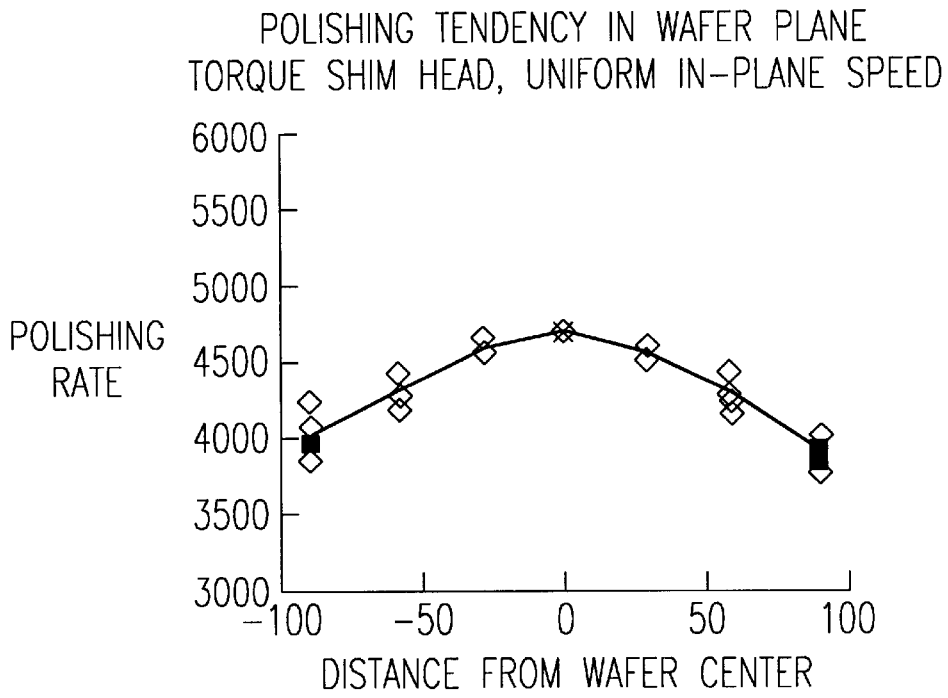
FIGS. 10A and 10B graphs for explaining results of wafer polishing obtained when the wafer holding head for the wafer polishing apparatus according to the present invention is applied to a practical example for which effective application of the present invention is expected.
Figure 10B:
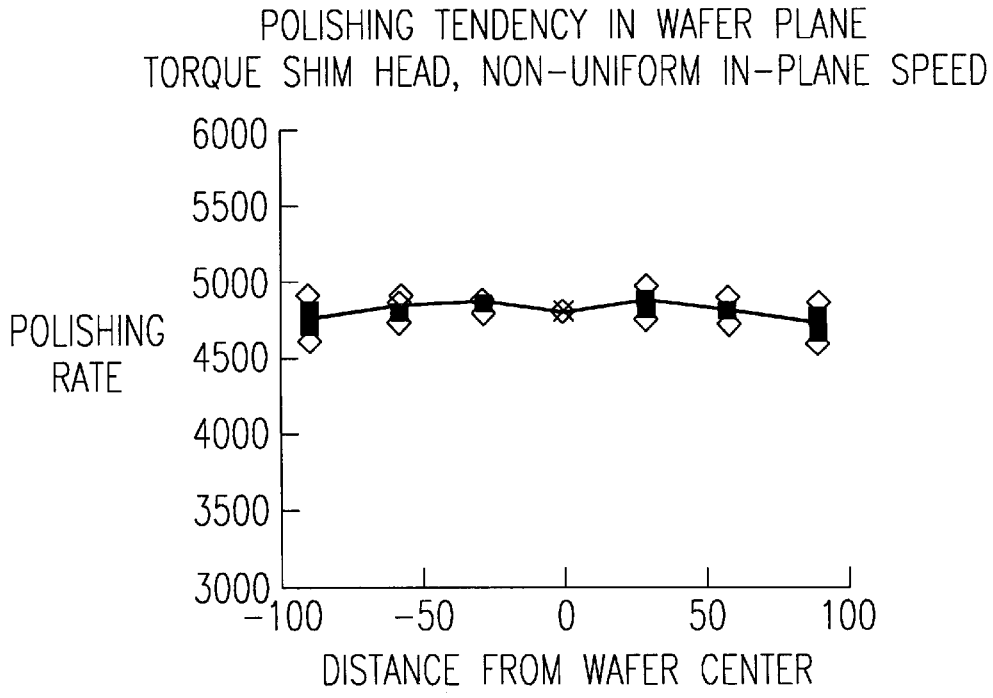

As a practical example of application, FIGS. 10A and 10B show experimental results obtained when employing the wafer holding head H2 for the wafer polishing apparatus according to the present invention in the case where the polishing rate in the outer peripheral area of the wafer W is lower than that in the central area thereof even under the in-plane speed uniform condition due to influences imposed from components of the apparatus. FIG. 10A shows a result of polishing obtained when the wafer W is polished under the in-plane speed non-uniform condition by using the wafer holding head H2 with the thin sheet 20 mounted in place. It is found from FIG. 10A that the polishing rate in the outer peripheral area of the wafer W is lower than that in the central area thereof. On the other hand, when polishing the wafer W under the in-plane speed non-uniform condition, the wafer W is polished substantially uniformly and a desired polished surface can be achieved, as shown FIG. 10B, because the outer peripheral area of the wafer W is preferentially polished.

As is apparent from the above description, such a tendency that the outer peripheral area of the wafer W is preferentially polished when polishing the wafer W under the in-plane speed non-uniform condition, which tendency has not been realized in the related art, can be realized by providing the thin plate 20 on the upper surface of the diaphragm 25 of the wafer holding head so that torsion of the diaphragm is reduced. Accordingly, even in the case of employing an apparatus having such a tendency that the central area of the wafer W is preferentially polished even under the in-plane speed uniform condition, a desired uniformly polished surface can be achieved by operating the apparatus under the in-plane speed non-uniform condition.

The wafer polishing apparatus and the wafer manufacturing method of the present invention can provide the following advantages.

According to the present invention, since the thin plate is disposed in contact with part of the diaphragm, deformation of the diaphragm in the axial (vertical) direction can be restricted. Therefore, a pressing force acting upon the retainer ring from the diaphragm can be reduced. A reduction of the pressing force acting upon the retainer ring enables a pressing force acting upon the polishing pad from the retainer ring to be reduced. As a result, when the polishing pad is made of a soft material and is apt to cause waving deformation, for example, the waving deformation can be prevented by providing the thin plate on the head body, and the wafer surface can be prevented from being excessively polished at an outer peripheral edge.

Since the thin plate is fixing by the fixing means (i.e., a second fixing device and a third fixing device) respectively to the carrier and the retainer ring with the diaphragm held therebetween, torsion of the diaphragm in the rotating direction of the head can be suppressed while deformation of the diaphragm in the vertical direction is restricted. Consequently, the wafer surface is uniformly polished.

A plurality of holes are formed in the thin plate in an annular pattern as a whole, each of the holes extending from the center side in a thin-plate plane outward in the rotating direction of the head, so that connecting portions between adjacent holes are flexed. Therefore, the thin plate is elastically deformable and elastic expansion and contraction of the diaphragm is maintained. As a result, displacements (floating) of the carrier and the retainer ring in the axial direction can be maintained to such an extent as not causing the waving deformation. Also, torsion acting upon the diaphragm in the rotating direction is reduced in a state where the wafer held on the wafer holding head is rotated while contacting the polishing pad. As a result, the wafer can be polished into a uniform surface.

Since the holes are formed radially inward and outward of the third fixing device in an annular pattern as a whole on each side, elastic deformation of the thin plate is stabilized. Therefore, elastic expansion and contraction of the diaphragm is surely maintained, and displacements of the carrier and the retainer ring in the axial direction can be maintained to such an extent as not causing the waving deformation. Also, torsion acting upon the diaphragm in the rotating direction is reduced in a state where the wafer held on the wafer holding head is rotated while contacting the polishing pad. As a result, stable polishing of the wafer can be achieved.

The holes formed radially inward of the third fixing device are positioned above a gap between the carrier and the retainer ring, and the holes formed radially outward of the third fixing device are positioned above a gap between the retainer ring and the peripheral wall of the head body. Therefore, elastic deformation of the thin plate in areas including the holes and thereabout is maintained with stability.

Since the holes are formed to have a width in the rotating direction of the head greater than a width of a connecting portion between adjacent two of the holes, the connecting portion is easier to flex. Therefore, elastic expansion and contraction of the diaphragm is more easily maintained, and the wafer can be polished into a uniform surface under a satisfactory floating effect developed.

Since the diaphragm and the thin plate are fixed to each other with a spacer interposed therebetween, the diaphragm and the thin plate are coupled in a stabler manner, and the thin plate can be kept from deforming when it is fixed to the diaphragm.

What is claimed is:

1. A wafer polishing apparatus having a platen including a polishing pad bonded to a surface thereof, and a wafer holding head both for holding a wafer to be polished and for bringing a first surface of said wafer into contact with said polishing pad to polish said wafer by separately rotating said wafer holding head and said platen, said wafer holding head comprising:

a head body made up of a top plate and a tubular peripheral wall provided under an outer periphery of said top plate;

a diaphragm stretched inside said head body, wherein said diaphragm is perpendicular to a head axis;

a pressure regulating mechanism for regulating a pressure of a fluid in a fluid chamber, wherein said fluid chamber is located between said diaphragm and said head body;

a carrier fixed to said diaphragm, wherein together said carrier and said diaphragm are displaceable in a direction of said head axis, and wherein said carrier holds a second surface of said wafer to be polished;

a retainer ring disposed between an inner surface of said tubular peripheral wall and an outer peripheral surface of said carrier in concentric relation, wherein said retainer ring is fixed to said diaphragm and together said retainer ring and said diaphragm are displaceable in said direction of said head axis so that said retainer ring is brought into contact with said polishing pad during polishing of said wafer;

an annular thin plate disposed in contact with at least part of said diaphragm; and a fixing device for fixing said annular thin plate to said head body, wherein said annular thin plate extends from said head body along a surface of said diaphragm.

2. The wafer polishing apparatus according to claim 1, further comprising second and third fixing devices for fixing said annular thin plate to said carrier and said retainer ring, respectively, with said diaphragm being held therebetween.

3. The wafer polishing apparatus according to claim 2, wherein a plurality of holes are formed in said annular thin plate to form an annular pattern as a whole, each hole of said plurality of holes extending outwardly from a first side near a center of a plane through a central longitudinal axis of said annular thin plate in a direction of rotation of said wafer holding head.

4. The wafer polishing apparatus according to claim 3, wherein each hole of said plurality of holes is formed radially inwardly and outwardly with respect to said third fixing device in said annular pattern on said first side and a second side.

5. The wafer polishing apparatus according to claim 4, wherein each hole of said plurality of holes, which is formed radially inwardly with respect to said third fixing device, is positioned above a gap between said carrier and said retainer ring, and wherein each hole of said plurality of holes, which is formed radially outwardly with respect to said third fixing device, is positioned above a gap between said retainer ring and said tubular peripheral wall of said head body.

6. The wafer polishing apparatus according to claim 5, wherein each hole of said plurality of holes is formed to have a width in said direction of rotation of said water holding head greater than a width of a connecting portion between first and second adjacent holes of said plurality of holes.

7. The wafer polishing apparatus according to claim 6, wherein said diaphragm and said annular thin plate are fixed to each other with a spacer interposed therebetween.

8. A wafer manufacturing method comprising the steps of;

holding a wafer to be polished on a wafer holding head, wherein said wafer holding head is installed in a wafer polishing apparatus having a platen including a polishing pad bonded to a surface thereof, and a wafer holding head both for holding said wafer to be polished and for bringing a first surface of said wafer into contact with said polishing pad to polish said wafer by separately rotating said wafer holding head and said platen, wherein said wafer holding head includes: a head body made up of a top plate and a tubular peripheral wall provided under an outer periphery of said top plate; a diaphragm stretched inside said head body, wherein said diaphragm is perpendicular to a head axis; a pressure regulating mechanism for regulating a pressure of a fluid in a fluid chamber, wherein said fluid chamber is located between said diaphragm and said head body; a carrier fixed to said diaphragm, wherein together said carrier and said diaphragm are displaceable in a direction of said head axis, and wherein said carrier holds a second surface of said wafer to be polished; a retainer ring disposed between an inner surface of said tubular peripheral wall and an outer peripheral surface of said carrier in concentric relation, wherein said retainer ring is fixed to said diaphragm and together said retainer ring and said diaphragm are displaceable in said direction of said head axis so that said retainer ring is brought into contact with said polishing pad during polishing of said wafer; an annular thin plate disposed in contact with at least part of said diaphragm; and a fixing device for fixing said annular thin plate to said head body, wherein said annular thin plate extends from said head body along a surface of said diaphragm; and polishing said wafer while said wafer is pressed against said polishing pad to form a polished wafer.

* * * * *